United States Patent [19]

Smith

[11] Patent Number: 4,461,607

[45] Date of Patent: Jul. 24, 1984

[54] REFUSE CONTAINER GRIPPING APPARATUS

[75] Inventor: Fred T. Smith, Palos Verdes Peninsula, Calif.

[73] Assignee: The Heil Co., Milwaukee, Wis.

[21] Appl. No.: 421,572

[22] Filed: Sep. 22, 1982

[51] Int. Cl.[3] ..... B65F 3/02

[52] U.S. Cl. ..... 414/406; 294/90; 294/106; 294/DIG. 2; 414/421

[58] Field of Search ..... 414/406, 408, 420, 421, 414/555, 729, 739; 294/90, 106, DIG. 2

[56] References Cited

U.S. PATENT DOCUMENTS 3,172,693 3/1965 Hansen ..... 294/90

4,227,849 10/1980 Worthington ..... 414/408

*Primary Examiner*—Robert G. Sheridan

*Attorney, Agent, or Firm*—Michael, Best & Friedrich

[57] ABSTRACT

An apparatus is provided for use on a refuse truck and for gripping a container and for causing the container to be dumped into the refuse truck. A pair of grabber arms are supported on a pivotable lifting arm, the grabber arms being adapted to surround a container for gripping the container. One of the grabber arms is pivotally joined to the lifting arm such that it is pivotable about a first axis from a container clamping position wherein the arm extends generally horizontally from the lifting arm, to a position wherein the grabber arm releases the container, and to a position wherein the grabber arm is in a retracted generally vertical position. The second grabber arm is similarly pivotable about a single axis from a generally horizontal clamping position to a generally vertical retracted position. The grabber arms are pivotable about their respective axes between the container gripping positions and the generally vertical positions in continuous uninterrupted motions. The grabber arms also include at least one container engaging member having one end adapted to engage said container and for preventing the container from sliding movement between the grabber arms when the container is raised to the container dumping position.

12 Claims, 7 Drawing Figures

REFUSE CONTAINER GRIPPING APPARATUS

FIELD OF THE INVENTION

The present invention relates to apparatus for use in lifting and dumping refuse containers into refuse trucks and, more particularly, to apparatus for gripping a refuse container and for lifting the container to dump the contents of the container into a collecting truck.

BACKGROUND OF THE INVENTION

Prior art apparatus for use in gripping and lifting a refuse container, and wherein the apparatus includes a pair of arms for grabbing the container, commonly includes at least one set of hydraulic cylinders adapted to cause movement of the grabber arms from a stored position wherein the arms extend generally vertically upwardly to a working position wherein the arms extend horizontally and for engaging the container. This apparatus also includes a second set of hydraulic cylinders to cause movement of the grabber arms toward and away from each other. Normally, a pair of hydraulic cylinders are provided to operate the grabber arms, one for each grabber arm.

Another feature of the prior art containers of the type used with such apparatus is that they commonly have a tapered configuration, the containers being narrower at the bottom than at the top. The containers are shaped in this manner to facilitate molding of the containers, to provide for stacking and to facilitate discharge of refuse from the containers when they are inverted and dumped into a refuse collecting truck. This characteristic of the containers, however, makes gripping of the containers by the grabber arms difficult and the containers may slide through the grabber arms when the containers are inverted. In an effort to prevent the containers from slipping through the grabber arms into the collecting truck, the prior art grabber arms are commonly constructed so as to firmly engage the container to the extent that the containers are substantially deformed. Such deformation of the containers tends to decrease their effective life. Additionally, the prior art grabber arms normally include a rubber facing cemented or vulcanized to the container engaging surfaces of the grabber arms in order to increase the frictional engagement between the grabber arms and the container. This bonded rubber material tends to tear away from the surface of the grabber arms, and maintenance problems may occur.

SUMMARY OF THE INVENTION

The invention provides an improved refuse container gripping apparatus including a grabber arm arrangment wherein only a single hydraulic cylinder is required to cause the grabber arms to move from a stored position to a container gripping position and to further cause movement of the grabber arms in a continuous motion toward and away from each other to grip and release refuse containers. The invention further provides an improved means associated with the grabber arms for firmly gripping the container so as to prevent the container from sliding through the grabber arms. This means for gripping permits a firm engagement with the container without substantial deformation of the sidewalls of the container, thereby improving the useful life of the containers.

More particularly, the invention includes an apparatus adapted to be supported on a refuse truck and for gripping a container and for causing the container to be dumped into the refuse truck. The apparatus includes a lifting frame adapted to be pivotally joined to the vehicle for pivotal movement about a horizontal axis, the frame including an end adapted to move from a lower container engaging position to a raised container dumping position. A pair of grabber arms are supported by the free end of the lifting frame, one of the grabber arms being adapted to be positioned on one side of the container and the other of the grabber arms being adapted to be positioned on an opposite side of the container. Means are also provided for pivotally joining the grabber arms to the lifting frame such that one of the arms is pivotable about a first axis from a container clamping position wherein the arm extends generally horizontally from the lifting frame to a second position where the grabber arm releases the container to a third position wherein the grabber arm is in a retracted generally vertical position. The other grabber arm is similarly pivotable about a second axis from a first clamping position to a position wherein the grabber arm releases the container and to a position where the grabber arm is in a retracted generally vertical position. The grabber arms are movable between the container gripping positions and the generally vertical positions in continuous uninterrupted motions.

One of the principal features of the invention is that the grabber arms are pivotable about axes which extend outwardly with respect to the refuse truck and upwardly, these axes diverging upwardly with respect to each other.

In a preferred embodiment of the invention the grabber arm pivot axes are inclined upwardly away from the truck at an angle of about 45° and the axes diverge upwardly and away from one another at an angle of about 45°.

In a preferred form of the invention a fluid cylinder is operably connected to one of the grabber arms to cause pivotal movement of that grabber arm, a first gear means is fixed to one of the grabber arms and is adapted to rotate about its pivot axis as the second grabber arm rotates. The second gear meshes with the first gear so as to transmit rotational movement of the first grabber arm to the second grabber arm.

Another of the principal features of the invention is the provision of means for preventing the container from slipping between the grabber arms into the refuse truck when the frame and grabber arms are moved to a container dumping position. This means for preventing slipping includes a container engaging member pivotally joined to one of the grabber arms and resiliently biased into engagement with the container when the grabber arms clampingly engage the container.

In a preferred embodiment of the invention the container engaging member includes one end having projections adapted to grip the container, and means are provided for pivotally connecting the container engaging member to the grabber arm such that that one end will be forced into tighter clamping engagement with the container if the container slips between the grabber arms when the frame and the grabber arms are in the container dumping position.

One of the advantages of the arrangement described is that the use of a single cylinder for effecting movement of the grabber arms from a stored position to the container gripping position and for also causing movement of the grabber arms to a position where they clampingly engage the container reduces the cost of the container dumping mechanism and facilitates reliability of operation of the system.

Another advantage of the present invention is that the container gripping members provide for a firm gripping of the container without substantial deformation of the container sidewalls or other damage to the container.

Various other features and advantages of the invention will be apparent by reference to the following description of a preferred embodiment, to the drawings, and to the claims.

Figure 1:
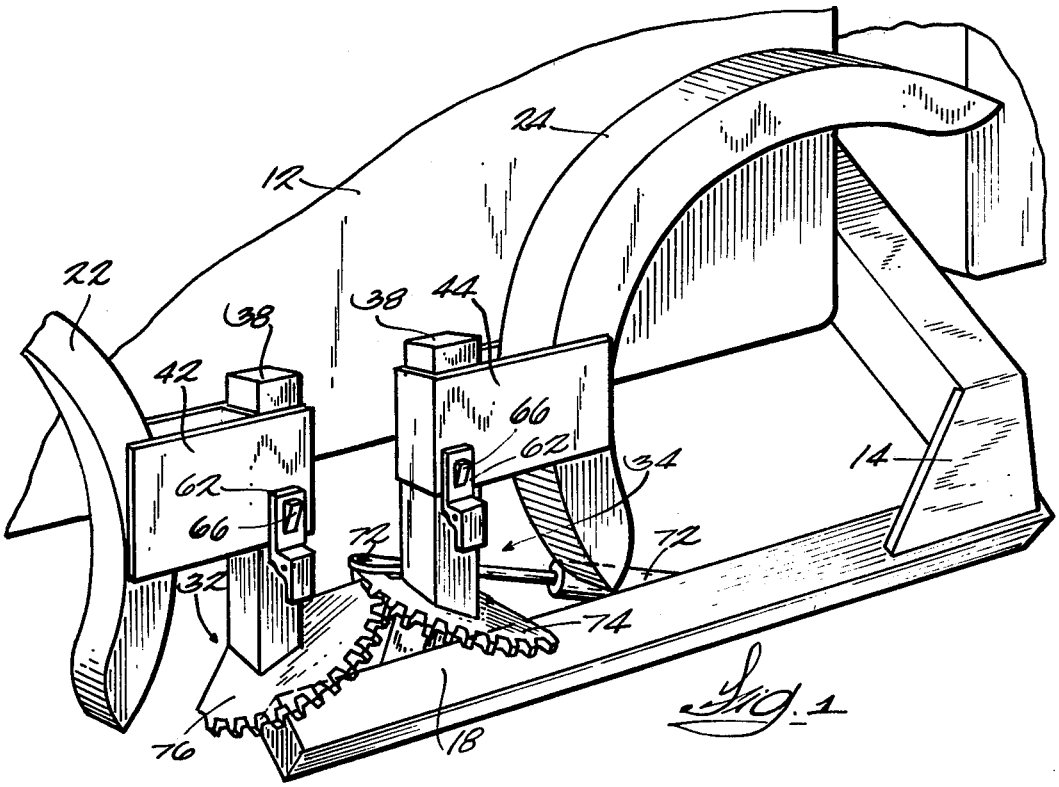
FIG. 1 is a perspective view of a refuse truck including apparatus embodying the invention and for gripping and lifting a refuse container.
Figure 2A:
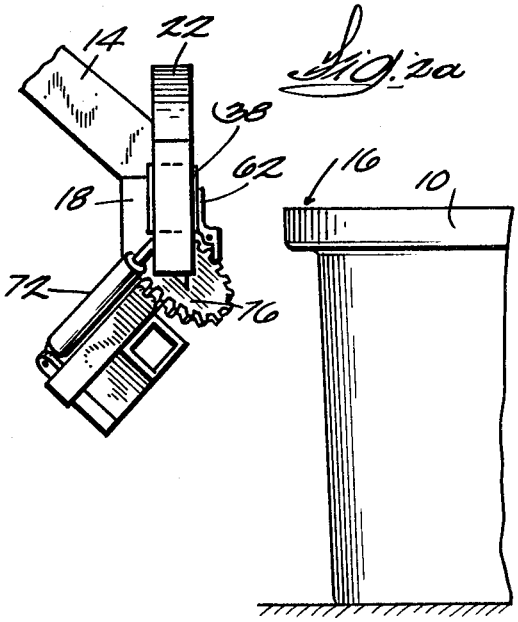
FIG. 2*a* is an end elevation view of the apparatus shown in FIG. 2.

Before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded s limiting.

DESCRIPTION OF A PREFERRED EMBODIMENT

Illustrated in FIG. 1 is an apparatus for gripping a container 10 of the type adapted to contain refuse or garbage and for lifting the container and dumping it into a refuse truck 12. While in the illustrated construction, the apparatus is shown as being employed with a side loading refuse truck and for gripping a container 10 at the side of the truck 12 and for dumping the container over the side of the truck, in other arrangements the apparatus could also be employed with rear loading refuse trucks.

The apparatus includes a lift arm 14 having one end pivotably joined to the truck frame for swinging movement between a container gripping position and a container dumping position. The lift arm 14 also includes a free end supporting a container grabber assembly.

The container grabber assembly includes a support arm 18 having one end fixed to the free end of the lift arm 14, the support arm 18 being supported in a horizontal relation and being positioned with its longitudinal axis generally parallel to the side of the truck 12. The free end 20 of the support arm 18 supports a pair of grabber arms 22 and 24 adapted to clampingly engage the container 10. Referring more particularly to the support arm 18, in the illustrated arrangement, it includes an elongated rigid beam having one end welded to the free end of the lift arm 14.

While the refuse containers 10 to be handled by the apparatus of the invention could have various constructions, the illustrated containers have a conventional generally cylindrical shape and are somewhat tapered such that the top of the container is wider than the bottom of the container.

While the grabber arms 22 and 24 have various shapes depending on the configuration of the container 10 to be handled, in the illustrated arrangement the grabber arms 22 and 24 are generally semi-circular and adapted to clampingly engage opposite sides of the container 10. More particularly, the grabber arms 22 and 24 each comprise a rigid beam being rectangular in cross-section, and the beams are each curved in a semi-circular configuration and having a radius of curvature substantially the same as that of the refuse container 10.

Figure 3:
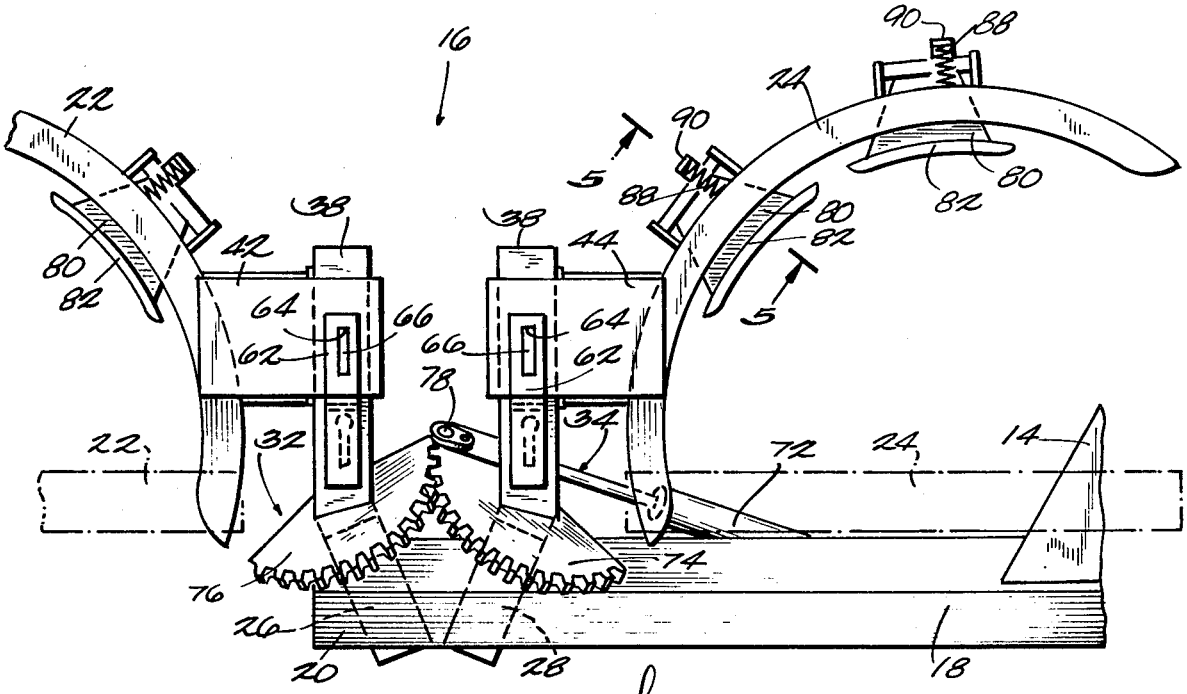
FIG. 3 is an enlarged partial elevation view of the apparatus shown in FIG. 2.
Figure 4:
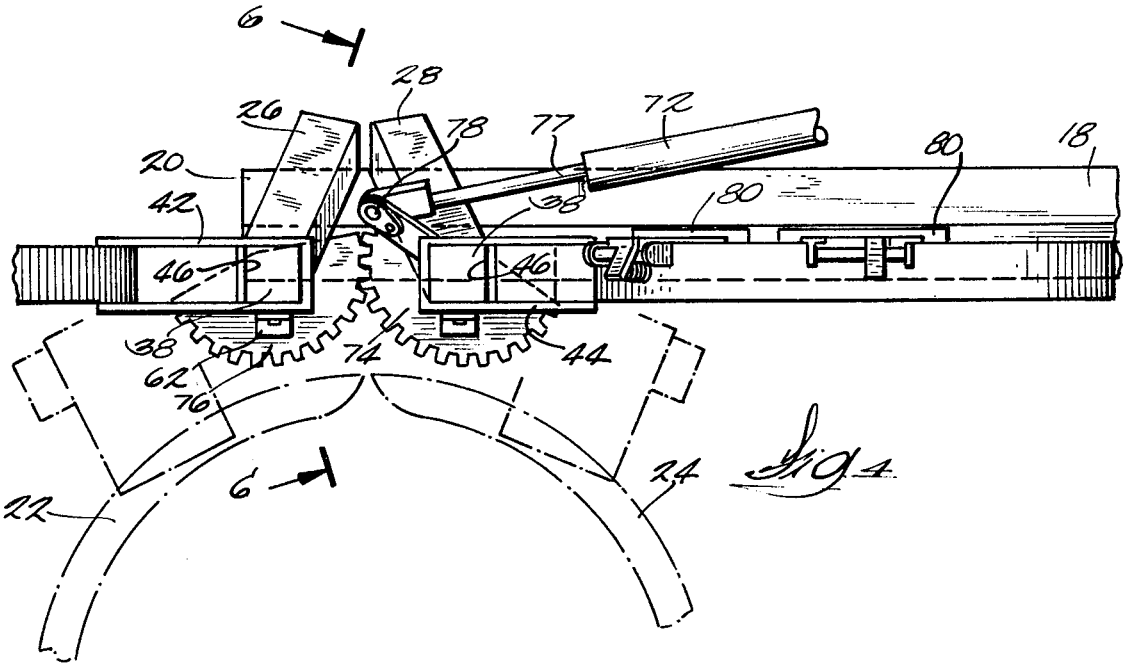
FIG. 4 is a plan view of the apparatus shown in FIG. 3.

Means are also provided for connecting the grabber arms 22 and 24 to the support arm 18 such that the grabber arms 22 and 24 are pivotable toward and away from each other and in a continuous arcuate motion between a first position wherein the grabber arms 22 and 24 are separated and lie in a generally vertical plane as shown in FIG. 3 and a grabbing position as shown in phantom in FIG. 4 wherein the grabber arms 22 and 24 pivot or rotate on oblique axes downwardly and toward each other to a position wherein they can engage opposite sides of the container 10 and wherein the grabber arms will then lie in a generally horizontal plane.

Figure 6:
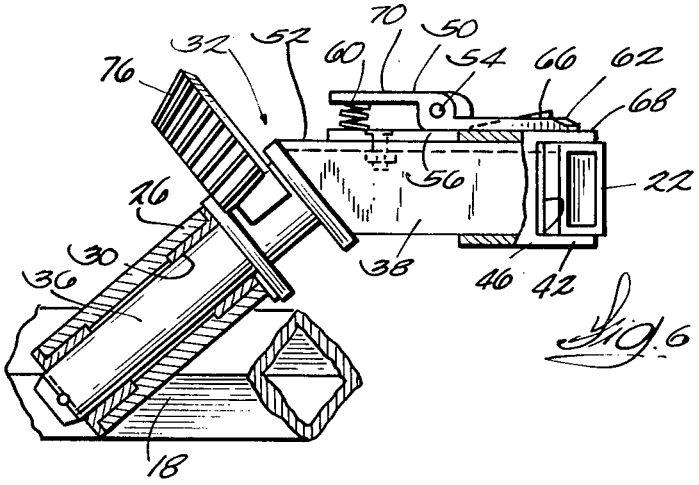
FIG. 6 is a cross-section view taken along line 6—6 in FIG. 4.

In the illustrated arrangement the means for connecting the grabber arms 22 and 24 to the support arm 18 includes a pair of bearing journals 26 and 28 welded or otherwise fixed to the free end 20 of the support arm or support beam 18. In the illustrated construction the bearing journals 26 and 28 have a rectangular or square cross sectional external configuration but are each provided with a cylindrical central longitudinally extending bore 30 (FIG. 6). The bearing journals 26 and 28 are fixed to the support arm 18 such that, when the support arm 18 is positioned such that the grabber arms 22 and 24 can grip a container 10, the longitudinal axes of the central bores 30 of the bearing journals 26 and 28 are inclined upwardly and outwardly away from the refuse truck 12 at an angle of approximately 45° with respect to a vertical plane parallel to the side of the refuse truck, and the axes of the central bores 30 are inclined upwardly away from each other at an angle of approximately 45°, i.e. at an angle of about 22° from a vertical plane bisecting the bearing journals 26 and 28 and perpendicular to the support arm 18.

The means from supporting the grabber arms 22 and 24 also includes a pair of pivot arms 32 and 34 supported by the bearing journals 26 and 28, respectively.

While the pivot arms 32 and 34 could have various constructions, in the illustrated arrangement they each include a pivot shaft or pivot pin 36 (FIG. 6) adapted to be housed in the central bore 30 of the respective bearing journal 26 or 28 and so as to be freely rotatable therein. The pivot arms 32 and 34 also each include a grabber arm support leg 38 having one end welded to the upwardly extending end of the pivot shaft 36 and generally extending at a right angle to that pivot shaft. In the illustrated construction the support leg 38 comprises a relatively short hollow beam having a generally square cross sectional configuration.

Means are also provided for joining the generally semi-circular beams of the grabber arms 22 and 24 to the support legs 38 in such a manner that the grabber arms 22 and 24 can be conveniently removed and replaced with grabber arms of alternative size or shape. The containers 10 to be handled by the apparatus described could be 90 gallon containers, 150 gallon containers, 300 gallon containers, etc. Since, the larger containers will be larger in diameter, different sizes of grabber arms 22 and 24 are needed for different sizes of containers. While the means for joining the grabber arms 22 and 24 to the support legs could have various constructions, in the illustrated arrangement, frame members 42 and 44, respectively, best shown in FIG. 3, are welded to the curved beam of the grabber arms 22 and 24, and the frame members each include an end defining a channel 46 and shaped (FIG. 4) so as to slidably house the generally square support leg 38. The frame members 42 and 44 and the attached grabber arms 22 or 24 are thus freely slidable onto the support legs 38.

Latch means (FIGS. 3 and 6) are also provided for conveniently releasably securing the frame members 42 and 44 of the grabber arms on the support legs 38. While the latch means could have various configurations, in the illustrated arrangement a pivotable latch member 50 is fixed to a surface 52 of each of the support legs and supported for pivotable movement about a pivot pin 54. More particularly, a plate 56 is bolted to the upper surface 52 of the support leg 38 and a pair of tabs (not shown) extend upwardly from the plate 56 and support the pivot pin 54. A compression spring 60 biases the pivotable latch member 50 toward the position shown in FIG. 6. The latch member 50 also includes a leg portion 62 having a rectangular central aperture 64 (FIG. 3). A wedge 66 is fixed to an upper surface 68 of each of the frame members 42 and 44. When the frame member 42 or 44 is slidably moved onto the support leg 38, the leg portion 62 of the pivotable latch member 50 will slide up the inclined surface of the wedge 66 until the wedge 66 is housed in the central rectangular aperture 64 in the leg portion 62. The frame member 42 or 44 can be slidably removed from the leg 38 by pushing down on the portion 70 of the pivotable latch member 50 to compress the spring 60 whereby the leg portion 62 will pivot to a position releasing the wedge member 66.

Figure 2:
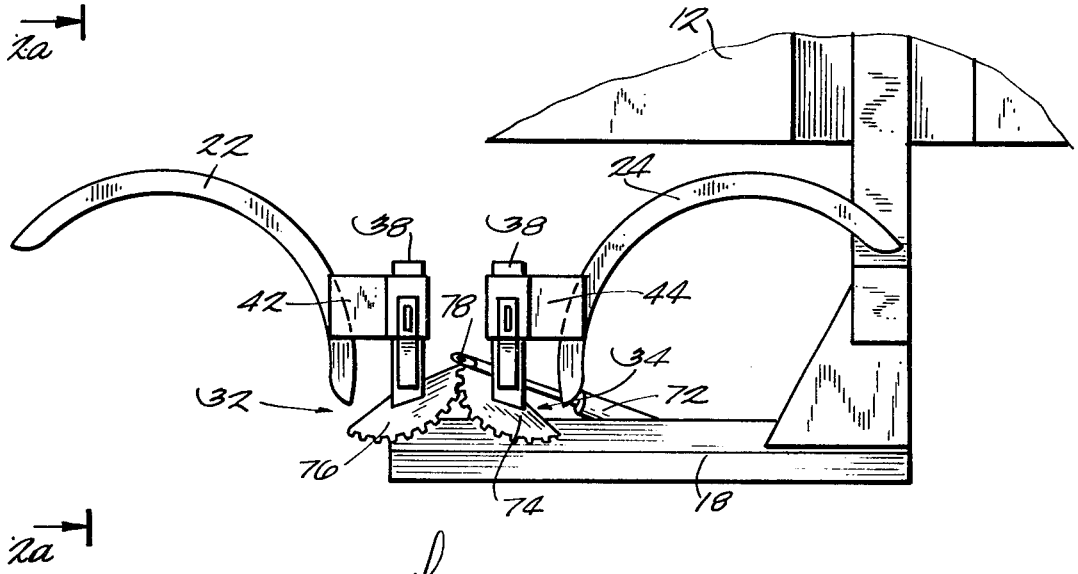
FIG. 2 is a side elevation view of the apparatus illustrated in FIG. 1.

Means are further provided for causing pivotal movement of the grabber arms 22 and 24 between the vertically oriented position or open position illustrated in FIGS. 2 and 3 and the container grabbing position shown in phantom in FIG. 4.

While in other embodiments of the invention the means for causing clamping movement of the grabber arms 22 and 24 could include a pair of hydraulic cylinders, in the illustrated construction means are provided for transmitting rotational movement of one the grabber arms to the other, thereby permitting the use of a single hydraulic cylinder 72 for rotating the grabber arms. The means for transmitting rotational movement includes a first gear segment 74 welded to the pivot shaft 36 of the pivot arm 34 and a second gear segment 76 welded to the pivot shaft 36 of the other pivot arm 34, the gear segments 74 and 76 being in meshing relation. Since the gears 74 and 76 mesh, rotation of one of the pivot pins 36 about its axis will be transmitted to the other pivot pin 36. Referring more particularly to the cylinder 72, while the piston 77 of the cylinder could be connected to one of the pivot arms in various way, in the illustrated arrangement, it is pivotally joined by pin 78 to the periphery of gear segment 74.

One of the advantages which result from the combination of elements decribed above, and particularly from the orientation of the grabber arms 22 and 24, from the means for mounting the grabber arms, and from the use of meshing gear segments 74 and 76 for drivingly connecting the grabber arms 22 and 24, is the use of a single hydraulic cylinder 72 for causing both movement of the grabber arms from the stored or vertically oriented position to the horizontal position and movement of the grabber arms into clamping engagement with the container.

The grabber arms 22 and 24 also include means for gripping the container and for preventing the container from slipping through the grabber arms when the container is lifted and pivoted to the position where it is being emptied into the refuse truck. In the illustrated arrangement, the means for gripping the container includes a plurality of locking members or levers 80 (FIGS. 3 and 5) pivotably supported by the grabber arms 22 and 24 and positioned so as to have one end 82 spring-biased into engagement with the container sidewall 84. While the grabber arms 22 and 24 could include more or fewer locking assemblies, in the illustrated construction, two locking members 80 are supported by each grabber arm. Since the locking assemblies are the same, only one will be described in detail.

The locking assemblies each include the pivotable locking member 80 and means for pivotably connecting the pivotable locking members to the grabber arms 22 or 24. While the pivotable locking member 80 could have other configurations, in the illustrated arrangement it extends inwardly toward the container, and the inner end or container engaging end 82 of the locking member is shaped so as to conform to the curvature of a portion of the container. The inner end 82 of the pivotable member also includes relatively sharp points or ridges 86 so as to frictionally engage the container. These inner points or ridges 86 of the locking members 80 are not, however, so sharp as to cut the rubber material comprising the container. The locking member 80 are positioned or supported beneath the grabber arms 22 and 24 and for pivotal movement between the solid line position and the phantom line position illustrated in FIG. 5. A compression spring 88 is also provided for biasing the locking members toward the position shown in phantom. In the illustrated arrangement, the locking member is generally L-shaped and includes a lever portion 90. The compression spring 88 is compressed between the grabber arm 24 and the lever portion 90 of the pivotable locking member in such a manner as to tend to bias the pivotable locking member counterclockwise as illustrated in FIG. 5.

Figure 5:
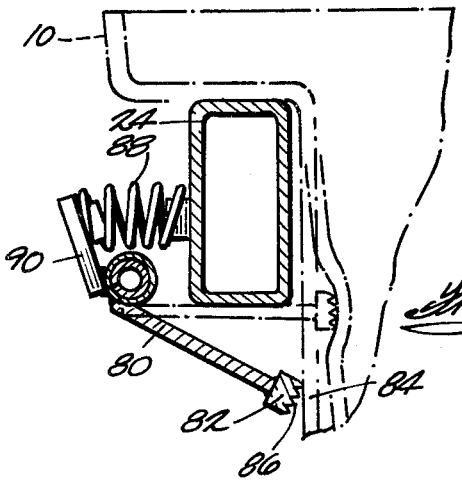
FIG. 5 is a cross-section view taken along line 5—5 in FIG. 3.

In operation of the locking assembly, as the grabber arms 22 and 24 are caused to move together into engagement with the container 10, the radially inner portions 82 of the locking members 80 will engage the container sidewalls 84, and then as the grabber arms clampingly engage the container as shown in FIG. 5, the compression springs will be compressed. The compression springs will thus maintain a force on the locking members 80 tending to hold them in engagement with the container sidewalls 84. During the dumping operation, when the container is inverted, if the container 10 begins to slide downwardly between the grabber arms 22 and 24, frictional engagement between the ends 82 of the locking members and the container will cause the locking members to pivot toward the position shown in phantom in FIG. 5. Such pivotal movement of the locking members 80 causes them to engage the container with even greater force. The counterclockwise pivotal movement of the locking members 80 is limited by the engagement of the locking members with the grabber arms 22 and 24. In this position, as shown in FIG. 5 in phantom, the locking members firmly engage the container and prevent any further sliding movement of the container through the grabber arms.

Various features of the invention are set forth in the following claims.

I claim:

1. Apparatus adapted to be supported on a refuse truck and for gripping a container and for causing the container to be dumped into the refuse truck, said apparatus comprising:

a frame adapted to be pivotally joined to the vehicle for pivotal movement about a horizontal axis, said frame including an end adapted to move from a lower container engaging position to a raised container dumping position, a pair of grabber arms for surrounding at least a portion of said container and for gripping said container, one of said grabber arms being adapted to be positioned on one side of said container and the other of said grabber arms being adapted to be positioned on an opposite side of said container, and means for pivotally joining said grabber arms to said frame such that, when said frame end is in said lower container engaging position, one of said arms is pivotable about a first axis from a container clamping position wherein said arm extends generally horizontally to clampingly engage the container to a position wherein said grabber arm releases said container and to a position wherein said grabber arm is in retracted generally vertical position, and such that the other of said grabber arms is pivotable about a second axis from a container clamping position wherein said other of said grabber arms extends horizontally to a position wherein said other of said grabber arms releases said container and to a position wherein said other of said grabber arms is in a retracted generally vertical position, said grabber arms being movable about said axes between said container gripping position and said generally vertical position in a continuous uninterrupted motion.

2. Apparatus for gripping a container as set forth in claim 1 wherein, when said frame end is in said lower container engaging position, said axes extend outwardly with respect to the refuse truck and upwardly, and wherein said axes diverge upwardly with respect to each other.

3. Apparatus for gripping a container as set forth in claim 1 wherein a first one of said grabber arms is pivotable about a single axis as said first grabber arm moves from said container gripping position to said generally vertical position and wherein said second one of said grabber arms is pivotable about a second single axis as said second grabber arm moves from said container gripping position to said generally vertical position.

4. Apparatus as set forth in claim 1 wherein, when said frame end is in said lower container engaging position, said first and second axes are inclined upwardly away from said truck at an angle of about 45°, and wherein said first and second axes diverge upwardly from one another at an angle of about 45°.

5. Apparatus for gripping a refuse container as set forth in claim 1 and further including means for causing pivotal movement of said grabber arms, said means for causing pivotal movement including a fluid cylinder operably connected to one of said grabber arms to cause pivotal movement of said one grabber arm, a first gear means fixed to one of said grabber arms and adapted to rotate about one of said axes as said first grabber arm rotates about said one of said axes, a second gear means fixed to the other said grabber arms and adapted to rotate about the other of said axes as said second grabber arm rotates about said other of said axes, said second gear means meshing with said first gear means so as to transmit rotational movement of said first grabber arm to said second grabber arm.

6. Apparatus for gripping a refuse container as set forth in claim 1 wherein said free end of said frame includes a horizontal support arm, and wherein said means for pivotally joining said grabber arms to said frame includes a first bearing journal fixed to said horizontal support arm, said first bearing journal including a first longitudinally extending bore, and a second bearing journal fixed to said horizontal support arm and being spaced from said first bearing journal, said second bearing journal including a second longitudinally extending bore, a first pivot arm including a pivot shaft rotatably housed in said first longitudinally extending bore and including means for supporting one of said grabber arms, and a second pivot arm including a pivot shaft rotatably housed in said second longitudinally extending bore and including means for supporting the other of said grabber arms.

7. Apparatus for gripping a refuse container as set forth in claim 6 wherein said means for supporting one of said grabber arms includes a rigid beam member fixed to said first pivot shaft and a grabber arm support bracket fixed to said one of said grabber arms and adapted to be slideably supported on said rigid beam member and for supporting said one of said grabber arms.

8. Apparatus for gripping a refuse container as set forth in claim 7 wherein said means for supporting one of said grabber arms further includes means for releaseably locking said grabber arm support bracket on said rigid beam member.

9. Apparatus for gripping a refuse container as set forth in claim 1 and further including means for preventing the container from sliding between the grabber arms into the refuse truck when said grabber arms are raised to said container dumping position, said means for preventing the container from sliding including a container engaging member pivotally joined to one of siad grabber arms and resiliently biased into engagement with the container when the grabber arms clampingly engage the container.

10. Apparatus for gripping a refuse container as set forth in claim 9 and wherein said container engaging member includes one end having projections adapted to grip the container, and further including means for pivotally connecting said container engaging member to said grabber arm such that said one end will be forced into tighter clamping engagement with the container if the container moves between said grabber arms when said grabber arms are in said raised container dumping position.

11. Apparatus for gripping a refuse container as set forth in claim 10 and further including spring means for biasing said container engaging member into engagement with said container.

12. Apparatus adapted to be supported on a refuse truck and for gripping a refuse container and for causing the refuse container to be dumped into the refuse truck, said apparatus comprising:

a frame adapted to be pivotally joined to the vehicle for pivotal movement about a horizontal axis, said frame including a free end adapted to move from a container gripping position to a raised container dumping position, a pair of grabber arms supported by said frame free end and supported by said free end for movement toward and away from each other to clampingly engage a container, and means for preventing the container from sliding movement with respect to the grabber arms when said container is raised to said container dumping position, said means for preventing sliding movement including a container engaging member having one end adapted to engage said container, said one end including means for frictionally engaging the container, and means for pivotally joining said container engaging member to one of said grabber arms such that said container engaging member one end moves toward said container and into tighter engagement with said container as said container moves with respect to said grabber arms.

* * * * *